US010059568B2

(12) United States Patent
Yuksel

(10) Patent No.: US 10,059,568 B2
(45) Date of Patent: Aug. 28, 2018

(54) SYSTEM OF HEXAGONAL BUILDING UNITS AND ESCALATORS OR MOVING WALKWAYS USED THEREIN

(71) Applicant: Edip Yuksel, Tucson, AZ (US)

(72) Inventor: Edip Yuksel, Tucson, AZ (US)

( * ) Notice: Subject to any disclaimer, the term of this patent is extended or adjusted under 35 U.S.C. 154(b) by 0 days.

(21) Appl. No.: 15/058,680

(22) Filed: Mar. 2, 2016

(65) Prior Publication Data

US 2016/0257531 A1 Sep. 8, 2016

Related U.S. Application Data

(60) Provisional application No. 62/126,824, filed on Mar. 2, 2015.

(51) Int. Cl.

| | |
|---|---|
| ***B66B 21/02*** | (2006.01) |
| ***B66B 21/12*** | (2006.01) |
| ***E04H 1/00*** | (2006.01) |
| ***B66B 21/00*** | (2006.01) |
| *B66B 21/08* | (2006.01) |

(Continued)

(52) U.S. Cl.

CPC ..... *B66B 21/025* (2013.01); *B66B 21/00* (2013.01); *B66B 21/12* (2013.01); *E04H 1/005* (2013.01); *B66B 21/02* (2013.01); *B66B 21/04* (2013.01); *B66B 21/06* (2013.01); *B66B 21/08* (2013.01); *B66B 21/10* (2013.01)

(58) Field of Classification Search

CPC ..... B66B 21/02; B66B 21/04; B66B 21/06; B66B 21/10; B66B 21/12; B66B 21/08; B66B 21/025; B66B 21/00; E04H 1/005

See application file for complete search history.

(56) References Cited

U.S. PATENT DOCUMENTS 406,314 A * 7/1889 Souder ..... B66B 21/08 198/327
629,289 A * 7/1899 Dodge ..... B66B 21/06 198/328

(Continued)

FOREIGN PATENT DOCUMENTS

DE 2325967 A1 * 12/1974 ..... B66B 21/06
EP 0074197 A2 * 3/1983 ..... B66B 21/12

(Continued)

OTHER PUBLICATIONS

International Search Report issued in application No. PCT/US 16/20451, dated Aug. 5, 2016 (12 pgs).

(Continued)

*Primary Examiner* — Babajide A Demuren
(74) *Attorney, Agent, or Firm* — Hayes Soloway PC

(57) ABSTRACT

A system of hexagonal building units is provided herein. The building units may be configured in a honeycomb configuration. The building units may be configured for a variety of different uses, including any of the following: residential, commercial, entertainment, community, government, retail, parking, storage, and office space. An escalator or moving walkway is also provided herein. The escalator or moving walkway may contain multiple lanes operating at varying speeds and may have a circular, oval, curved or straight shape. The escalator or moving walkway may also include at least one lane having segments that operate at different speeds.

4 Claims, 5 Drawing Sheets

(51) Int. Cl.

| | |
|---|---|
| *B66B 21/04* | (2006.01) |
| *B66B 21/10* | (2006.01) |
| *B66B 21/06* | (2006.01) |

(56) References Cited

U.S. PATENT DOCUMENTS

| | | | | | |
|---|---|---|---|---|---|
| 1,277,614 | A | | 9/1918 | Lowrey | |
| 2,823,785 | A | | 2/1958 | Hefti | 198/17 |
| 2,905,100 | A | | 9/1959 | Kendall et al. | 104/25 |
| 3,482,529 | A | | 12/1969 | Paul | 104/25 |
| 3,592,140 | A | | 7/1971 | Zuppiger | 104/25 |
| 3,621,980 | A | * | 11/1971 | Folkes | B65G 15/02 198/792 |
| 3,727,558 | A | * | 4/1973 | Winkle | B66B 29/08 104/21 |
| 3,899,067 | A | * | 8/1975 | Kondo | B66B 23/26 104/18 |
| 4,444,302 | A | * | 4/1984 | Dunstan | B66B 21/12 104/173.1 |
| 5,971,129 | A | | 10/1999 | Stawniak et al. | 198/325 |
| 6,170,632 | B1 | * | 1/2001 | Shimura | B66B 21/12 104/167 |
| 6,454,079 | B1 | * | 9/2002 | Teramoto | B65G 23/30 198/334 |
| 8,104,600 | B2 | * | 1/2012 | Sanchez Pineiro | B66B 21/08 198/333 |
| 8,960,097 | B2 | | 2/2015 | Fritsche | 104/53 |
| 2011/0059821 | A1 | | 3/2011 | Lee et al. | 474/8 |
| 2013/0062157 | A1 | | 3/2013 | Betancourt | 198/334 |
| 2014/0321698 | A1 | | 10/2014 | Chao et al. | 382/103 |

FOREIGN PATENT DOCUMENTS

| | | | | | |
|---|---|---|---|---|---|
| EP | 0415953 | B1 | * | 8/1992 | B66B 21/06 |
| FR | 330546 | A | * | 8/1903 | B66B 21/06 |
| FR | 390604 | A | * | 10/1908 | B66B 21/06 |
| FR | 2431406 | A1 | * | 2/1980 | B66B 21/12 |
| GB | 203187 | A | * | 9/1923 | B66B 21/06 |
| GB | 1176444 | A | * | 1/1970 | B66B 21/12 |
| GB | 2230753 | B | * | 3/1993 | B66B 21/06 |
| GB | 2316927 | B | * | 8/1998 | B66B 21/04 |
| JP | H092766 | | | 1/1997 | B66B 21/04 |
| JP | 09110350 | A | * | 4/1997 | |
| JP | H09110350 | | | 4/1997 | B66B 21/10 |

OTHER PUBLICATIONS

"B-and-Bee camping concept proposes stackable sleeping cells for festivals", Datasheet [online], Dezeen Magazine, Jul. 24, 2014 {retrieved on Aug. 8, 2016]. Retrieved from the Internet: URL:http://www.dezeen.com/2014/07/24/h-and-bee-camping-concept-stackable-sleep-cells-festivals/ (27 pgs).

PCT Invitation to Pay Additional Fees issued in application No. PCT/US16/20451, dated May 12, 2016 (2 pgs).

International Preliminary Report on Patentability issued in application No. PCT/US2016/020451, dated Sep. 14, 2017 (9 pgs).

* cited by examiner

SYSTEM OF HEXAGONAL BUILDING UNITS AND ESCALATORS OR MOVING WALKWAYS USED THEREIN

CROSS REFERENCE TO RELATED APPLICATION

This application claims priority from U.S. Provisional Application Ser. No. 62/126,824, filed Mar. 2, 2015, the contents of which are incorporated herein by reference.

FIELD OF THE DISCLOSURE

This disclosure relates to a system of hexagonal building units or complexes that may be arranged in various configurations to optimize use of space for a variety of different usages. The disclosure also relates to a moving walkway or escalator for use in the hexagonal building units or other public spaces that may include one or more lanes with variable speeds.

BACKGROUND OF THE DISCLOSURE

Efficient usage of space in building design is an important consideration in a variety of different settings, and particularly in crowded urban environments. While there are many benefits to living in a densely populated area, including energy efficiencies, quality of life for the residents can often be drastically improved by efficiently designing buildings and other structures to centralize a variety of different needs of the residents, including residential housing, work, education, entertainment, shopping, dining, recreation, etc. Doing so can decrease or eliminate long commute times, as well as facilitate greater opportunities for improved social interaction among the residents. The efficient design of these buildings and structures can further be enhanced by maximizing the usage of space and by providing conveyance systems within the space that provide residents an efficient method to travel throughout the building or structure.

Accordingly, there exists a need heretofore unmet in the relevant field to address the needs of residents in populated areas to provide such buildings or structures that maximize the efficient and optimal usage of space for a variety of different applications.

SUMMARY OF THE DISCLOSURE

Embodiments of the present disclosure provide a system of hexagonal building units. Briefly described, one embodiment of a system of hexagonal building units, among others, can be implemented as follows. The system of hexagonal building units may comprise two or more hexagonal building units arranged in a honeycomb configuration. The hexagonal building units may optionally vary in height and may be configured to accommodate one or more of the following usages: residential, commercial, entertainment, community, government, retail, parking, storage, and office space.

In another embodiment, the present disclosure also provides an escalator or moving walkway. One embodiment, among others, can be implemented as follows. The escalator or moving walkway may comprise two or more adjacent lanes moving at different speeds, with a transition escalator or moving walkway therebetween for achieving a gradual change in speed. In a preferred embodiment the speeds of the circular or oval lanes increase incrementally, starting from both outermost and innermost lanes, reaching a top speed in a middle lane. The lanes may optionally be configured in one of a circular, oval, curved, or straight shape and may also optionally vary in width.

In another embodiment, the escalator or moving walkway comprises at least one lane, wherein a first segment of the lane operates at a different speed from an adjacent second segment of the lane. The escalator or moving walkway may optionally comprises two or more lanes and may optionally be configured in one of a circular, oval, curved, or straight shape.

The features, functions, and advantages that have been discussed can be achieved independently in various embodiments of the present disclosure or may be combined in yet other embodiments, further details of which can be seen with reference to the following description and drawings.

Other features, functions and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

The present disclosure relates to a system of hexagonal building units or complexes. The building units will typically be regular hexagons, such that each of the six sides of the building unit is the same length as the other five sides. However, the building units may also be irregular hexagons in certain embodiments, such that they include sides of different lengths. Furthermore, in certain embodiments, the system may contain hexagonal building units that are both regular and irregular and/or of different sizes.

The building units may have a hexagonal footprint, base or foundation where the building unit rises from the ground. Alternatively, the building units may have a non-hexagonal footprint, base, or foundation from which the hexagonal portion of the building rises. Similarly, multiple hexagonal building units may share a common footprint, base or foundation, which may be of any suitable shape or design.

Figure 1:
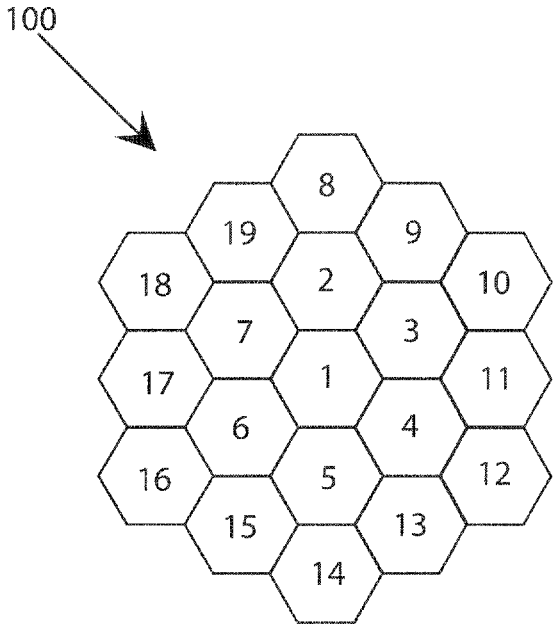
FIG. 1 shows a top view of a system of hexagonal building units in accordance with the present disclosure.

FIG. 1 depicts a top view of one possible configuration of a system of hexagonal building units 100 according to the present disclosure. In a preferred embodiment, the building units may be arranged in a honeycomb configuration. In this configuration, the hexagonal building units are generally arranged such that three hexagonal building units meet at each vertex. Adjacent building units may share a common side. Alternatively, there may be spacing between adjacent building units to allow for walkways, bridges, open air spaces, and the like between the building units. Further, adjacent sides of building units may be fully shared or adjoined with each other, or only partially shared or adjoined with each other. The general honeycomb configuration may be utilized even though it may not include three building units at every vertex in the configuration. For example, the outermost building units may be positioned adjacent to empty space or other structures. Similarly, one or more inner building units in the honeycomb configuration may be replaced by open spaces or other structures. Any other configuration of multiple hexagonal building units may be used to arrange the building units, including partial honeycomb configurations in which only some of the building units are arranged as described above. Furthermore, individual building units may be arranged into complexes or clusters of building units, and a system may include multiple complexes or clusters of building units. For example, in a preferred embodiment, a system of the present disclosure may include six complexes, each having nineteen building units, for a total of 114 building units. Each complex or cluster of building units may be identical or different in configuration and/or number of building units from the other complexes or clusters in a system.

A preferred configuration of the building units is depicted in FIG. 1. This configuration allows for an arrangement of up to nineteen hexagonal building units. In a preferred embodiment, innermost building unit 1 may be omitted. For example, it may be replaced by open space. Similarly, any of the other building units 2-19 depicted in FIG. 1 may be replaced by open space. These open spaces may be used for a variety of different usages including, for example, parks, atria, parking lots, recreation areas, exercise areas, walking paths, green areas, ponds, pools, gardens, other structures or buildings, etc.

Figure 2:
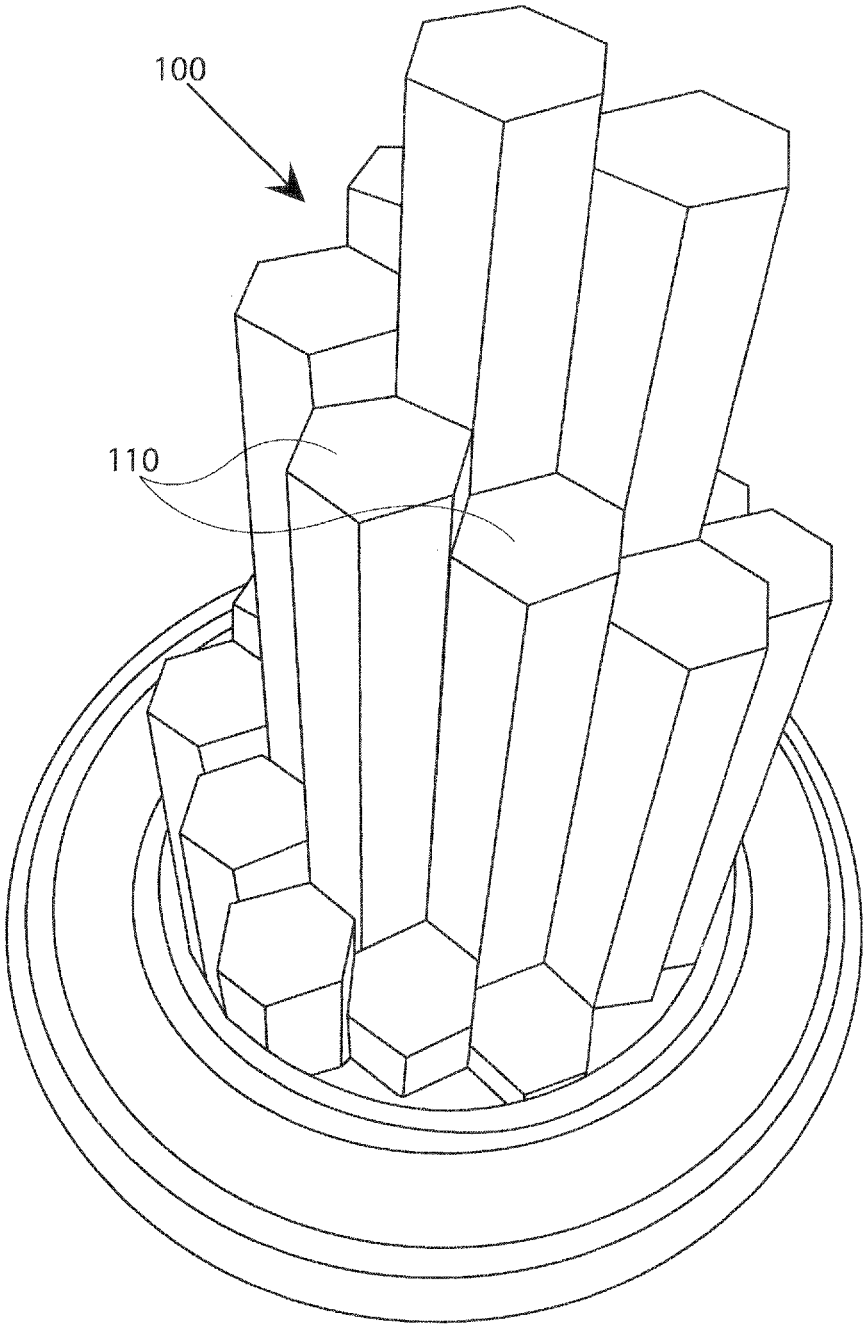
FIG. 2 shows a perspective view of a system of hexagonal building units in accordance with the present disclosure.

A perspective view of a system of hexagonal building units is depicted in FIG. 2. As can be seen from this figure, the heights of the building units in the system may be varied. Building units of any height known in the art may be utilized. Thus, building units as low as a single story, as well as building units built as tall as may feasibly be achieved may be utilized in the system, as well as all heights in between. The arrangement of building units of different heights may follow a pattern. Considerations that may be involved in determining how to arrange units of different heights may include, for example, maximizing, minimizing, or optimizing exposure to natural light, providing or maintaining desirable views, or zoning considerations. For example, as shown in FIG. 2, building unit height may increase in a spiral configuration, with the innermost building unit being the tallest. Other patterns may be used such as varying height by concentric rings of building units, etc. Alternatively, no discernible pattern of building unit heights may be used when configuring the building units in the system.

As is shown in FIG. 2, each building unit includes a rooftop 110. The rooftop 110 may be flat or may include multiple levels. Rooftop 110 of one building unit may be accessible from rooftops of one or more other building units, for example, by stairs, ramps, escalators, motorized walkways, bridges, tube bridges, covered walkways, etc. Rooftop 110 of a building unit may also adjoin and/or be accessible from a floor or multiple floors of one or more adjacent building units via, for example doors or entryways, or via stairs, ramps, escalators, motorized walkways, bridges, tube bridges, covered walkways, etc. Rooftop 110 of a building unit may be configured for a variety of different uses, including, for example, one or more of the following: a garden, terrace, pool, spa, recreation area, exercise area, park, tennis court, or vehicle parking.

The building units may also extend underground to include basement areas, for example. These areas may maintain the hexagonal shape of the building unit or may comprise different shapes. Multiple building units may share an underground or basement area or may each have their own underground or basement area. The underground areas may provide access between two or more building units. The underground areas may also provide space for a distribution center for distributing various goods (e.g., groceries, supplies, commodities, etc.) to one or more building units. The goods may be distributed and/or delivered, for example, via a series of tubes connected to one or more building units, road ways, pathways, elevators, escalators, moving walkways, conveyor belts, or a combination thereof. Keeping with "green" considerations, energy efficient, low or zero emission vehicles such as hydrogen-fueled or battery or solar-powered trucks may be used to deliver orders, particularly those that include large items (e.g., furniture). Goods may be delivered according to a set schedule or may be ordered on demand, for example, by internet, phone, or in person.

The systems of hexagonal building units of the present disclosure provide optimum space usage and may be configured for a number of different uses. These include, for example, uses related to residential, commercial, entertainment, community, government, retail, vehicle parking, storage, and office space applications. Each individual building unit may be configured for one or more of these uses. Similarly, different building units within a system may be configured for the same or different uses.

Figure 3:
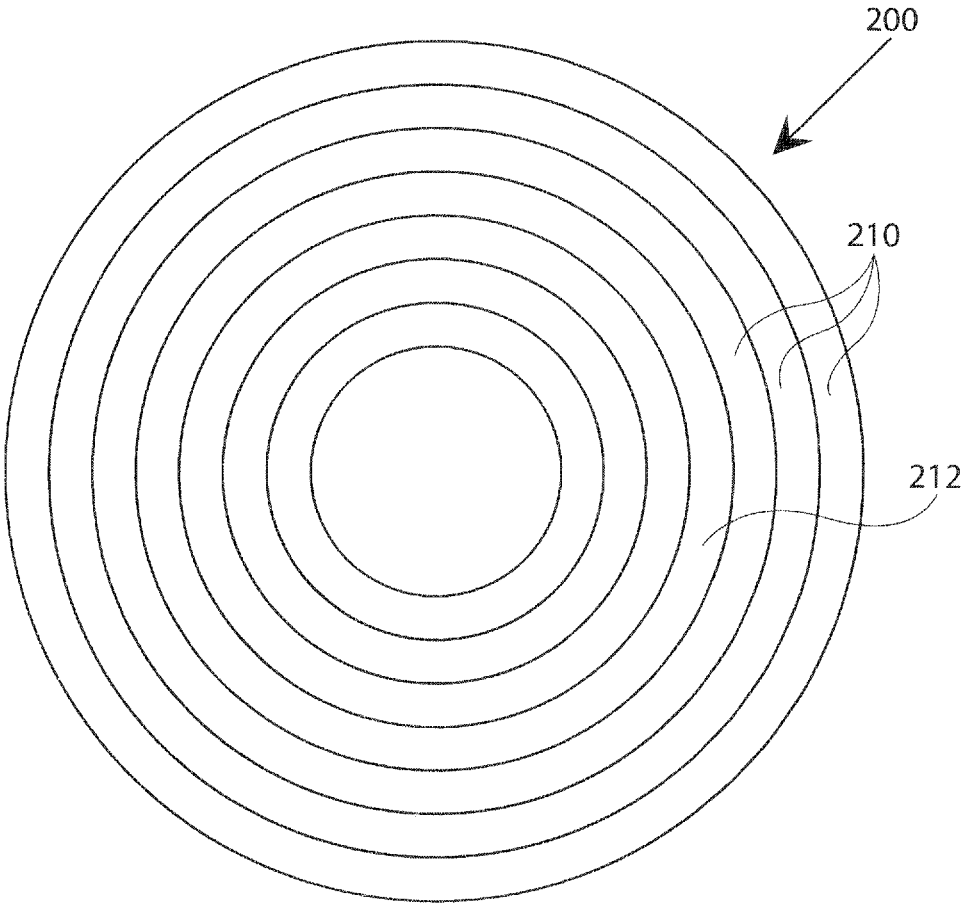
FIG. 3 shows a top view of a circular, multi-lane escalator or moving walkway in accordance with the present disclosure.

Also provided by this disclosure is an escalator or moving walkway that may be used within the system of hexagonal building units described above. As shown in FIG. 3, in a preferred embodiment the escalator or moving walkway 200 may comprise a circular or oval shape. Alternatively, the escalator or moving walkway may be straight or comprise a curved shape. Furthermore, the escalator or moving walkway may operate on a flat surface or may operate along an inclined surface. The escalator or moving walkway may comprise a single lane 210 or two or more lanes 210, as is depicted in FIG. 3. The lanes will typically all move in the same direction, although some lanes may move in opposite directions. Each lane of the escalator or moving walkway may vary in width and speed. In a preferred embodiment, the fastest moving and widest lane is in the middle and the slowest moving and narrowest lanes are the innermost and outermost lanes. An individual lane may incrementally increase or decrease in speed relative to an adjacent lane, or may operate at the same speed as an adjacent lane. Preferably transition lanes 212 are provided between faster and slower moving lanes to achieve a gradual change in speed, such as described in US Publication US 2013/0062157, and Japanese published applications Nos. JP 09110350A and JP 092766A, the contents of which are incorporated herein by reference. Accordingly, in a preferred embodiment, users of the escalator or moving walkway may enter at the slowest moving lane (e.g., the innermost and/or outermost lane) and progress through incrementally faster transitional lanes to reach the fastest moving lane (e.g., the middle lane), thereby minimizing travel time over a particular distance safely and efficiently.

Figure 4:
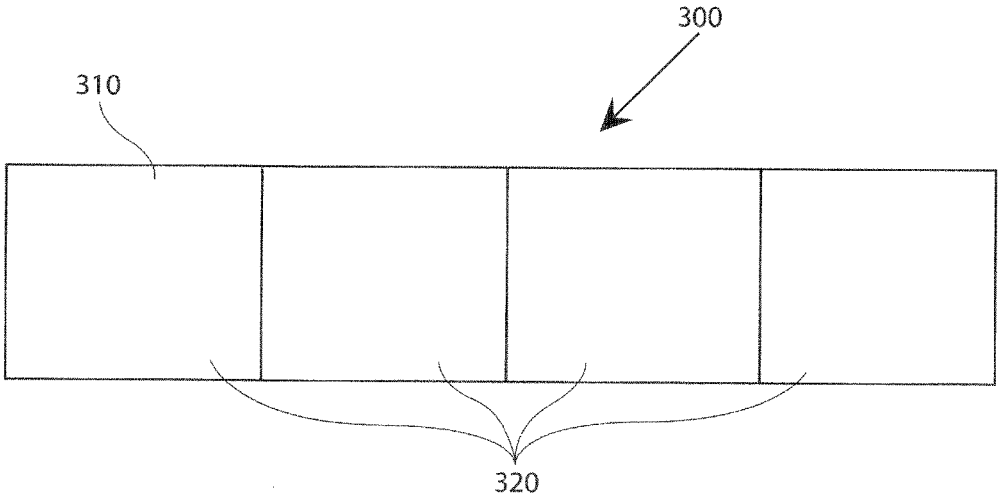
FIG. 4 shows a top view of a straight escalator or moving walkway having a single lane including segments that operate at varying speeds in accordance with the present disclosure.

In another preferred embodiment shown in FIG. 4, an individual lane 310 of the escalator or moving walkway 300 may operate at different speeds at different points along the lane. In this embodiment, the lane 310 may be divided into two or more segments 320 along its length. Each segment 320 may vary in length, or all segments 320 of the lane 310 may be of the same length. In a preferred embodiment, an individual segment may simultaneously operate at an incrementally faster or slower speed relative to an adjacent segment. For example, the segments at the ends of the lane may operate at the slowest speeds, while the segment or segments in the middle may operate at incrementally faster speeds, with the middle-most segment operating at the fastest speed. Lane 310 comprising two or more segments 320 operating at varying speeds may be included in an escalator or moving walkway of a variety of shapes, including straight, curved, circular or oval. Lane 310 may further be used in an escalator or moving walkway having two or more lanes, one or more which may operate at constant speed.

Figure 5:
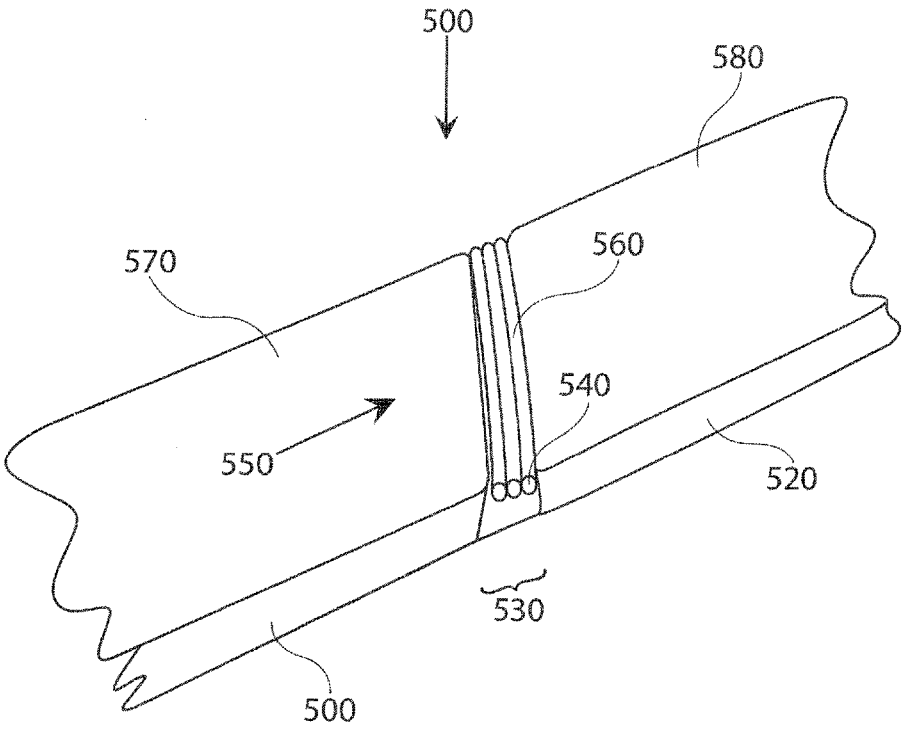
FIG. 5 shows a perspective view of a transition between two segments of a moving walkway in accordance with the present invention.

Another preferred embodiment is shown in FIG. 5 in which one segment 500 of a moving walkway 510 operates a different linear speed than an immediately adjacent walkway segment 520. In order to smooth the transition between walkway segment 500 and 520, a short transition segment 530 having one or more rollers 540 is mounted with the roller(s) axis perpendicular to the travel path 550. Roller(s) 540 are mounted to be freely rotating.

Transition segment 530 is mounted so that the peripheral surfaces 560 of roller(s) 540 are slightly below the surfaces 570 and 580 of walkway segments 500 and 520, respectively. Transition segment 530 should be only a few inches long, at most, typically 2-4 inches so that it is shorter than a human foot.

The escalators or moving walkways of the present disclosure may be powered by a conventional supply of electricity or may alternatively run on other power supplies, such as solar power. The escalators or moving walkways may operate via motorized conveyer belts, for example, such as those found in treadmills and the like. The walking surfaces may comprise any durable material such as rubber or metal. Handrails or other supports may be positioned continuously or at various points along the escalator or moving walkway.

Within the systems of hexagonal building units described above, the escalators or moving walkways may be used to convey people or objects from one part of a hexagonal building unit to another or between hexagonal building units. They may be sized to accommodate a large or small number of passengers at a single time and/or to cover large or small distances. In one exemplary embodiment, a circular escalator or moving walkway comprising thirteen concentric lanes may have the following specifications:

| | | |
|---|---|---|
| External Lane's Radius: | 300 | m |
| Internal Lane's Radius: | 287.5 | m |
| Middle Lane's Length: | 1.9 | km |
| Transitional Lanes' Widths: | 0.75 | m |
| Middle Lane's Width: | 3.5 | m |
| Internal and External Lanes' Speed: | 4.5 | km/h |
| Speed Increments between Lanes: | 4.5 | km/h |
| Middle Lane's Speed: | 31.5 | km/h |

It should be emphasized that the above-described embodiments of the present disclosure, particularly, any "preferred" embodiments, are merely possible examples of implementations, merely set forth for a clear understanding of the principles of the disclosure. Many other variations and modifications may be made to the above-described embodiments of the disclosure without departing substantially from the spirit and principles of the disclosure. All such modifications and variations are intended to be included herein within the scope of the present disclosure and protected by the following claims.

What is claimed is:

1. A transport escalator or moving walkway comprising three or more adjacent lanes including two outer lanes and at least one inner lane, configured at least in part in at least one of a circular, oval, and curved shape, wherein each lane moves in a same direction, but at different transport speeds, and in which the transport speeds of the lanes increase starting from the two outer lanes, reaching a top speed in an inner lane.

2. The escalator or moving walkway of claim 1, wherein at least two of the lanes have different widths.

3. The escalator or moving walkway of claim 1, wherein the lanes move at different speeds which increase incrementally, starting from the two outer lanes, reaching a top speed in a middle lane.

4. The escalator or moving walkway of claim 1, wherein the lanes move at different speeds which decrease incrementally, starting from a middle lane, reaching a lowest speed in the outer lanes.

* * * * *